US009347260B1

(12) United States Patent
Wong

(10) Patent No.: US 9,347,260 B1
(45) Date of Patent: May 24, 2016

(54) CURTAIN CONTROLLER CAPABLE OF PREVENTING PULL CORD FROM JUMPING AWAY

(71) Applicant: Ming Lu Wong, Kaohsiung (TW)

(72) Inventor: Ming Lu Wong, Kaohsiung (TW)

( * ) Notice: Subject to any disclaimer, the term of this patent is extended or adjusted under 35 U.S.C. 154(b) by 0 days.

(21) Appl. No.: 14/530,663

(22) Filed: Oct. 31, 2014

(51) Int. Cl.
*E06B 9/322* (2006.01)

(52) U.S. Cl.
CPC ..... *E06B 9/322* (2013.01)

(58) Field of Classification Search
CPC ..... E06B 9/307; E06B 9/322
USPC ..... 160/177 R
See application file for complete search history.

(56) References Cited

U.S. PATENT DOCUMENTS 6,561,254 B1 * 5/2003 Liu ..... E06B 9/322 160/177 R
6,761,204 B1 * 7/2004 Chou ..... E06B 9/322 160/177 R
8,640,762 B2 * 2/2014 Wong ..... E06B 9/32 160/177 R
2003/0010457 A1 * 1/2003 Kao ..... E06B 9/303 160/177 R
2007/0251653 A1 * 11/2007 Liu ..... E06B 9/322 160/177 R
2008/0202702 A1 * 8/2008 Liu ..... E06B 9/307 160/167 R
2010/0012281 A1 * 1/2010 Wong ..... E06B 9/322 160/343
2010/0147470 A1 * 6/2010 Wong ..... E06B 9/323 160/370
2012/0091246 A1 * 4/2012 Chou ..... E06B 9/322 242/364
2015/0152681 A1 * 6/2015 Chou ..... E06B 9/322 242/389

* cited by examiner

*Primary Examiner* — Blair M Johnson
(74) *Attorney, Agent, or Firm* — Guice Patents PLLC

(57) ABSTRACT

A curtain controller capable of preventing pull cord from jumping away. The curtain controller is applied to a lower rail to prevent the pull cord from jumping away. The front end of the controller main body has a connection seat main body. A stopper bar is transversely rotatably connected with the connection seat main body. The stopper bar can be rotated to block or unblock the space above the pull cord winder so as to prevent the pull cord from jumping out of the pull cord winder and facilitate the winding of the pull cord on the pull cord winder. The pull cord winder is assembled with the controller main body by an inclination angle so as to lower the height of the pull cord winder. In this case, the curtain controller can be mounted on a lower rail to speed the assembling process.

4 Claims, 6 Drawing Sheets

CURTAIN CONTROLLER CAPABLE OF PREVENTING PULL CORD FROM JUMPING AWAY

BACKGROUND OF THE INVENTION

1. Field of the Invention

The present invention relates generally to a curtain controller, and more particularly to a curtain controller, which can prevent the pull cord from jumping away and is mountable on a lower rail to speed the assembling process.

2. Description of the Related Art

In order to mount a conventional curtain controller in a lower rail, the size of the curtain controller is generally minified in adaptation to the height of the lower rail. Moreover, in structural design, the upper side of the pull cord winder is especially free from any structure to open the upper space so that a user can conveniently wind the pull cord onto the pull cord winder with hands. Therefore, the pull cord can be very quickly and conveniently wound on the pull cord winder of the conventional pull cord controller. However, there is no stop above the pull cord winder so that in operation of the pull cord, the jumping pull cord often jumps out of the pull cord winder from the upper side thereof to cause clog of the pull cord. This is a quite troublesome problem to a user.

SUMMARY OF THE INVENTION

It is therefore a primary object of the present invention to provide a curtain controller capable of preventing pull cord from jumping away. The front end of the controller main body has a connection seat main body. A stopper bar is transversely rotatably connected with the connection seat main body. When the stopper bar is rotated to a position where the stopper bar axially forward extends, the stopper bar is positioned above the pull cord winder to prevent the pull cord from jumping upward. When the stopper bar is 90-degree rotated to a transverse position, the space above the pull cord winder is fully unblocked. Under such circumstance, a user can conveniently and quickly wind the pull cord onto the pull cord winder with hand.

To achieve the above and other objects, the curtain controller capable of preventing pull cord from jumping away of the present invention includes a controller main body receivable in a curtain rail, a stopper bar connected with a connection seat on upper side of front end of the controller main body, a pull cord winder disposed in the controller main body by an inclination angle and a worm wheel drivingly engaged with the pull cord winder. When the stopper bar is rotated to a position where the stopper bar axially forward extends, the stopper bar is positioned above the pull cord winder to prevent the pull cord from jumping upward. When the stopper bar is 90-degree rotated and located by the connection seat in a transverse position, the space above the pull cord winder is unblocked from the stopper bar. Under such circumstance, a user can more conveniently and quickly wind the pull cord onto the pull cord winder.

Moreover, in order to mount the curtain controller on a lower rail, the pull cord winder is assembled with the controller main body by an inclination angle so as to lower the total height of the controller main body. In this case, the curtain controller can be mounted on the lower rail. Accordingly, the installation range is widened.

The present invention can be best understood through the following description and accompanying drawings, wherein:

DETAILED DESCRIPTION OF THE PREFERRED EMBODIMENTS

Figure 1:
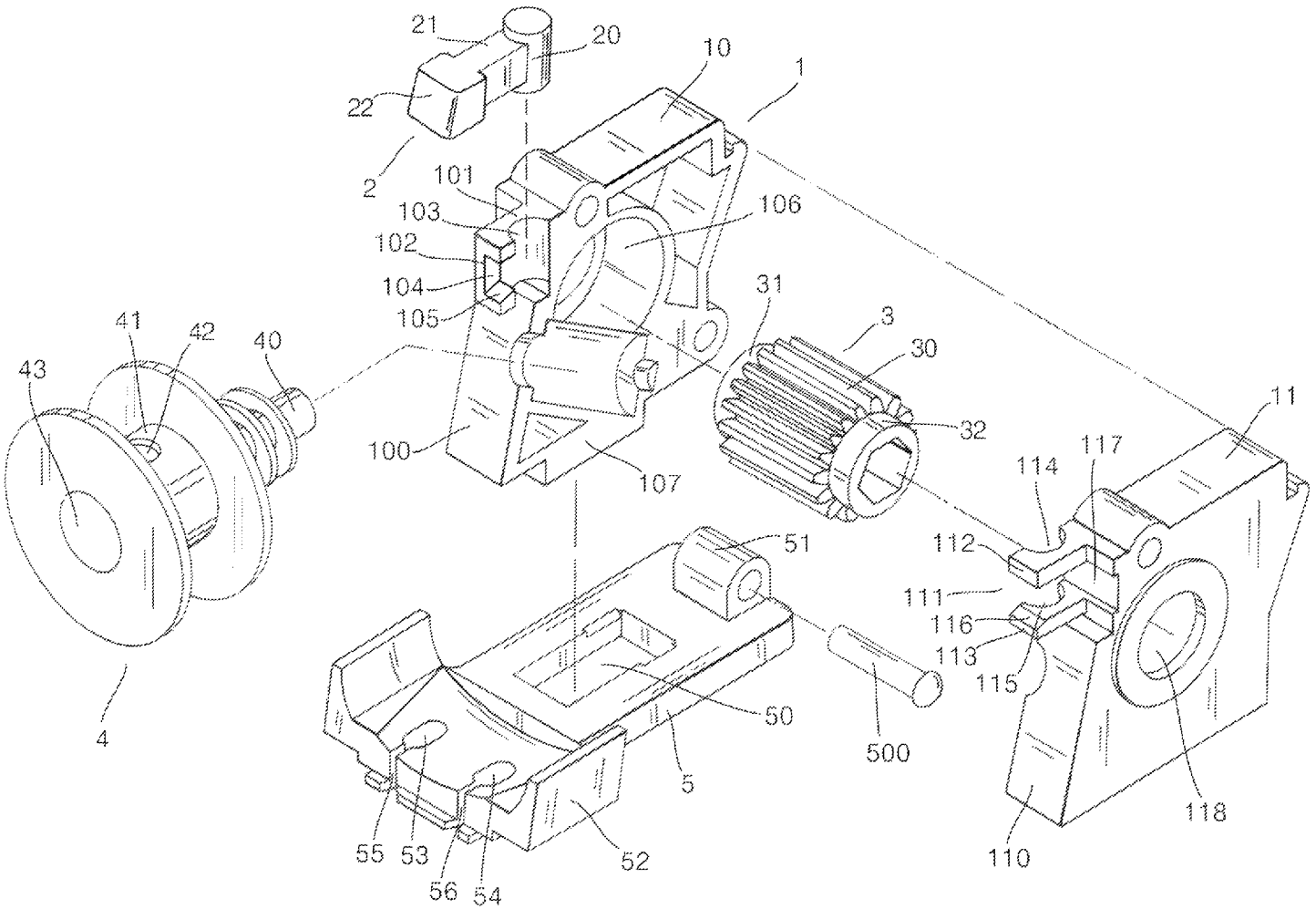
FIG. 1 is a perspective exploded view of the present invention.
Figure 2:
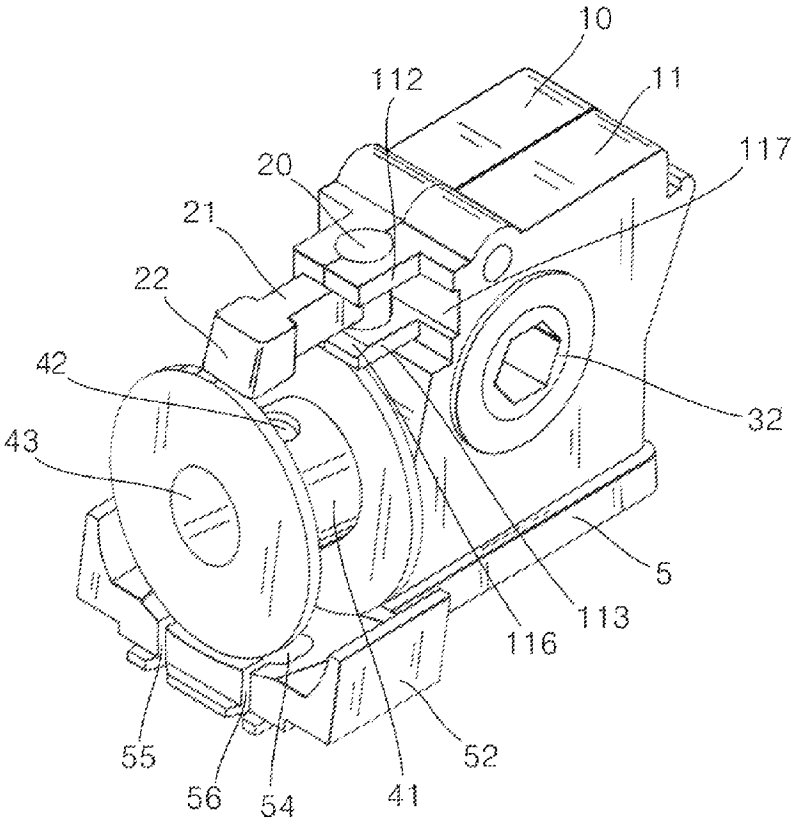
FIG. 2 is a perspective assembled view of the present invention.

Please refer to FIGS. 1 and 2, which show the components and the assembly of the components of the present invention. The present invention includes a controller main body 1 composed of a first casing 10 and a second casing 11 mated with each other, a stopper bar 2 rotatably mounted on upper side of front end of the controller main body 1 by means of insertion, a worm wheel 3 received in the controller main body 1, a pull cord winder 4 for fixedly winding the pull cord thereon and a movable cover board 5 for enhancing the locating effect.

Each of the first and second casings 10, 11 has a front end in the form of a slope structure 100, 110. A connection seat 101, 111 integrally extends from upper side of the front end slope 100, 110 of the each of the first and second casings 10, 11. One side of the connection seat 101 of the first casing 10 is a closed wall 102, while another side of the connection seat 101 is formed with a semicircular hole 103. The front end of the semicircular hole 103 communicates with a hollow space 104. The bottom face of the hollow space 104 is formed with a slope structure 105 with locating effect. The connection seat 111 of the second casing 11 includes an upper arm 112 and a lower arm 113. The two arms 112, 113 define therebetween a front hollow space and a lateral hollow space. In addition, one side of each of the two arms 112, 113 is formed with a semicircular hole 114, 115 corresponding to the semicircular hole 103 of the connection seat 101 of the first casing 10. The semicircular holes 114, 115 can be mated with the semicircular hole 103 to together form a circular hole. The lower arm 113 is formed with a slope 116 with locating effect. The rear ends of the upper and lower arms 112, 113 are formed with an engagement channel 117 for locating the stopper bar 2. The first and second casings 10, 11 are mated with each other to form a connection seat main body with a circular hole and hollow space at the front end of the controller main body 1. A cylindrical column 20 of the stopper bar 2 is inserted and connected in the circular hole of the connection seat main body, whereby the stopper bar 2 can be rotated within the hollow space.

The cylindrical column 20 is formed at the rear end of the stopper bar 2. A cantilever 21 extends from the front end of the cylindrical column 20. A wider stopper block 22 is formed at the front end of the cantilever 21. The cylindrical column 20 of the stopper bar 2 is connected in the circular hole of the connection seat, whereby the cantilever 21 and the stopper block 22 can be horizontally rotated within the hollow space of the connection seat main body.

Moreover, the opposite inner faces of the first and second casings 10, 11 are formed with perforations 106, 118 corresponding to each other. The worm wheel 3 has a toothed section 30 and two sleeve sections 31, 32 on two sides. The sleeve sections 31, 32 are received in the perforations 106, 118, whereby the worm wheel 3 is rotatable within the controller main body 1. The pull cord winder 4 has a threaded rod 40 on one side. The toothed section 30 of the worm wheel 3 is engaged with the thread of the threaded rod 40 to drivingly rotate the pull cord winder 4.

The pull cord winder 4 has a pull cord reel 41 on the other side. The pull cord reel 41 integrally extends from the threaded rod 40 for a pull cord to fixedly wind thereon. The circumference of the pull cord reel 41 is formed with a through hole 42 in communication with the shaft hole 43 of the pull cord reel 41. The pull cord is conducted through the through hole 42 into the shaft hole 43 to be knotted and affixed to pull cord reel 41. The threaded rod 40 of the pull cord winder 4 is received in a receiving socket formed on the opposite inner sides of the first and second casings 10, 11 by a predetermined inclination angle. The first and second casings 10, 11 are mated with each other, whereby the pull cord reel 41 is connected with one side of the controller main body 1 in an inclined state. In addition, connection blocks 107 protrude from the bottom ends of the first and second casings 10, 11. The first and second casings 10, 11 are mated with each other and the connection blocks 107 are engaged in a window 50 of the movable cover board 5 to locate the movable cover board 5. In this case, the first and second casings 10, 11 are more securely assembled with each other.

A shaft seat 51 protrudes from the rear end of the movable cover board 5. A shaft rod 500 is passed through the shaft seat 51 to pivotally connect the movable cover board 5 with the controller main body 1, whereby the movable cover board 5 can be downward turned. The front end of the movable cover board 5 has a cord locating seat 52. The end face of the cord locating seat 52 is formed with two locating holes 53, 54 for the pull cord to pass through and locate. The cord locating seat 52 is further formed with splits 55, 56 in communication with the locating holes 53, 54. Accordingly, the pull cord can be conveniently quickly engaged into the locating holes 53, 54 from outer side through the splits 55, 56 or pulled out of the locating holes 53, 54 through the splits 55, 56 to achieve a fast assembling effect.

Figure 3:
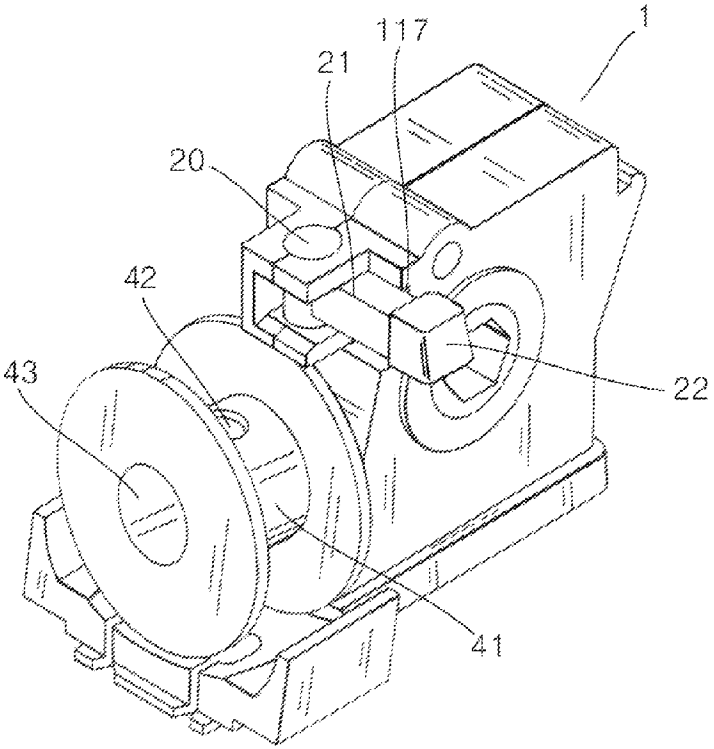
FIG. 3 is a perspective assembled view according to FIG. 2, showing that the stopper bar is opened.
Figure 4:
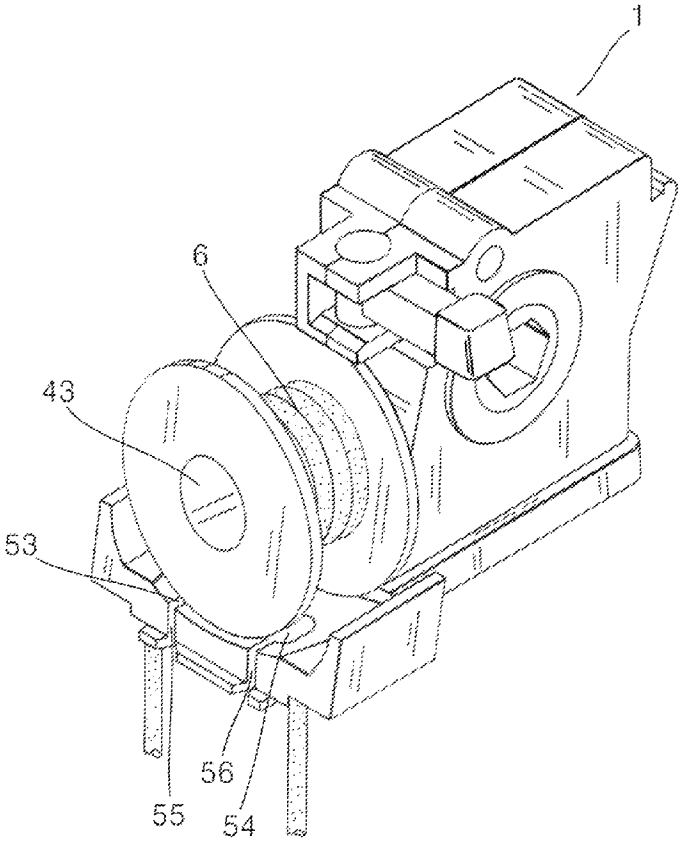
FIG. 4 is a perspective assembled view according to FIG. 3, showing that the pull cord is wound on the pull cord reel.
Figure 5:
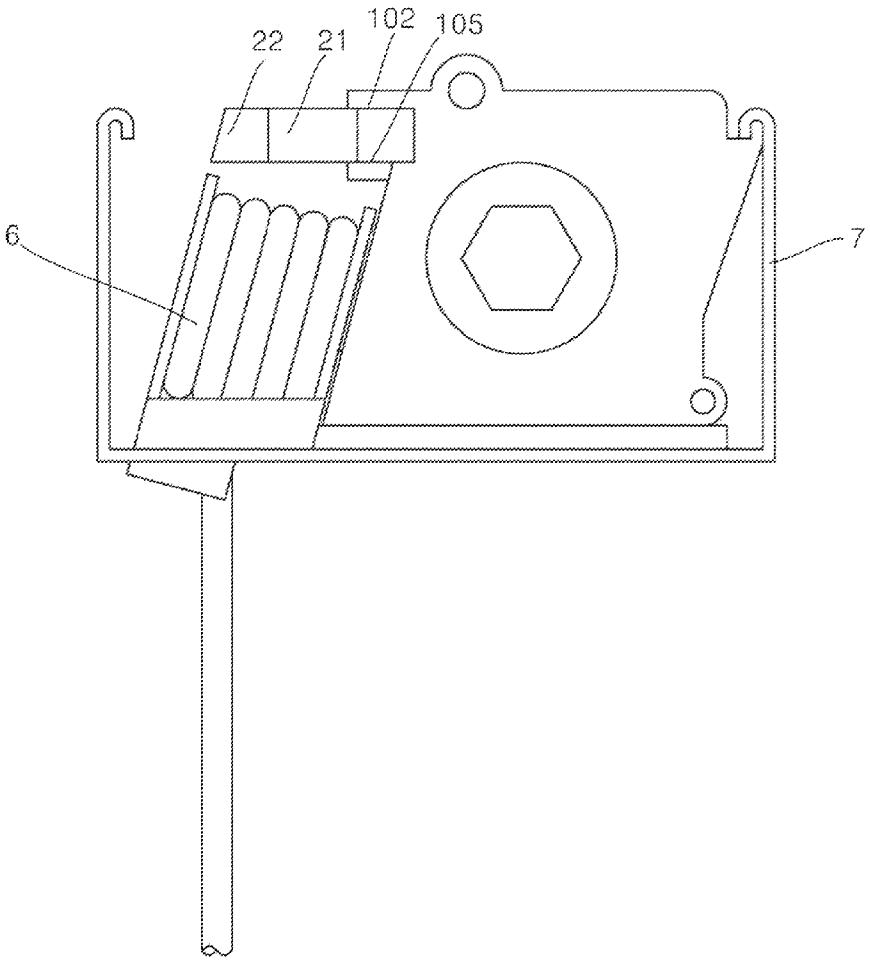
FIG. 5 is a side view of the present invention, showing that the stopper bar is closed.
Figure 6:
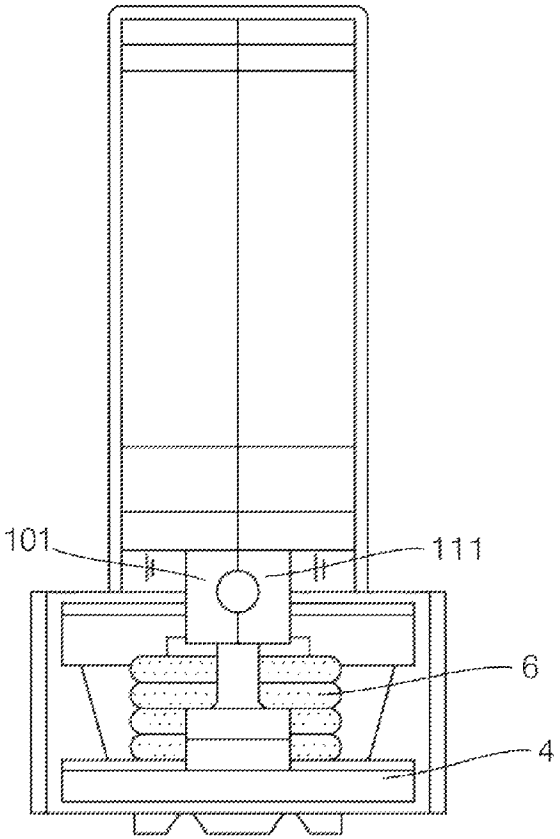
FIG. 6 is a plane view of the present invention, showing the installation thereof.

FIGS. 3 to 6 show the installation of the controller of the present invention. When assembling and winding the pull cord, the cantilever 21 and the stopper block 22 of the stopper bar are horizontally rotated around the cylindrical column 20 away from the upper side of the pull cord winder 4. The cantilever 21 and the stopper block 22 of the stopper bar pass through the hollow space of the connection seat main body and move to a position normal to the controller main body 1 and engage into the engagement channel 117 to be located therein (as shown in FIG. 3). At this time, an operator can conduct the pull cord 6 into the through hole 42 of the circumference of the pull cord reel 41 and then knot the pull cord 6 to fix the pull cord 6 in the shaft hole 43. Thereafter, the pull cord 6 is wound on the pull cord reel 41 and engaged into the locating holes 53, 54 through the splits 55, 56 of the cord locating seat 52 (as shown in FIGS. 3 and 4). The process can be very conveniently and quickly completed. Then, the controller main body 1 is located on a lower rail 7. Finally, the cantilever 21 and the stopper block 22 of the stopper bar are rotated to a position where the stopper bar axially forward extends. Accordingly, the cantilever 21 is right stopped by the closed wall 102 of the connection seat 101 and positioned above the pull cord 6 (as shown in FIG. 5). The connection seat main body composed of the two connection seats 101, 111 locates the stopper bar in the axially forward extending position to block the space and hinder the pull cord 6 from upward jumping. In this case, the pull cord 6 is prevented from jumping out of the pull cord winder 4 to achieve a locating effect (as shown in FIG. 6).

The above embodiments are only used to illustrate the present invention, not intended to limit the scope thereof. Many modifications of the above embodiments can be made without departing from the spirit of the present invention.

What is claimed is:

1. A curtain controller capable of containing a pull cord therein, the curtain controller comprising:

a controller main body receivable in a curtain rail, a stopper bar connected with a connection seat main body located on an upper side of a front end of the controller main body, a pull cord winder disposed in the controller main body and positioned at an inclined angle relative to the controller main body and a worm wheel drivingly engaged with the pull cord winder;

wherein the controller main body is composed of a first casing and a second casing corresponding to each other, the first casing having a front end formed with a slope structure, a connection seat extending outwardly from an upper side of the slope structure, a groove being formed on the connection seat, a hollow space being further formed on the connection seat in communication with the groove, the second casing having a connection seat corresponding to the connection seat of the first casing, the connection seat of the second casing includes two arms being an upper arm and a lower arm, the two arms defining therebetween a front hollow space and a lateral hollow space, one side of each of the two arms being formed with an upper groove and a lower groove corresponding to the groove of the connection seat of the first casing for mating with the connection seat of the first casing, the connection seats of the first and second casings being mated with each other to form a connection seat main body having a circular hole and a hollow space, the groove of the connection seat of the first casing and the upper groove and the lower groove of the connection seat of the second casing defining the circular hole of the connection seat main body, the connection seat main body protruding from the front end of the controller main body;

wherein the stopper bar has a cylindrical column disposed at a rear end of the stopper bar, the cylindrical column being pivotally connected in the circular hole of the connection seat main body of the controller main body, a cantilever extending from a front end of the cylindrical column, a stopper block being formed at a front end of the cantilever and having a width that is wider than a width of the cantilever, the cantilever and the stopper block extending out of the hollow space of the connection seat main body of the controller main body; and wherein the pull cord winder having a threaded rod with a thread and a pull cord reel extending from one side of the threaded rod, the threaded rod being received in the controller main body along the slope of the front of the controller main body, whereby the pull cord reel is positioned under the stopper bar by an inclination angle, the stopper bar being movable to block or unblock the space above the pull cord winder so as to prevent the pull cord from jumping out of the pull cord winder and facilitate the winding of the pull cord on the pull cord winder.

2. The curtain controller as claimed in claim 1, wherein one side of the connection seat of the first casing is a closed wall, while another side of the connection seat is formed with the groove, a front end of the groove communicating with the hollow space for mating with the connection seat of the second casing.

3. The curtain controller as claimed in claim 2, wherein a bottom section of the hollow space is formed with a slope for locating the stopper bar.

4. The curtain controller as claimed in claim 1, wherein rear end of the connection seat of the second casing is formed with an engagement channel for locating the stopper bar.

* * * * *